United States Patent [19]

Chadshay

[11] 4,434,747

[45] Mar. 6, 1984

[54] BURNER-TILT DRIVE APPARATUS FOR A PULVERIZED COAL FIRED STEAM GENERATOR

[75] Inventor: Roman Chadshay, Windsor, Conn.

[73] Assignee: Combustion Engineering, Inc., Windsor, Conn.

[21] Appl. No.: 393,288

[22] Filed: Jul. 1, 1982

[51] Int. Cl.[3] ..... F22B 37/42; F22D 5/00

[52] U.S. Cl. ..... 122/449; 110/261; 110/263; 110/347; 122/479 B

[58] Field of Search ..... 110/185, 186, 263, 264, 110/347, 261; 122/449, 479 B; 431/186, 189

[56] References Cited

U.S. PATENT DOCUMENTS 4,252,069 2/1981 McCartney ..... 110/261

4,304,196 12/1981 Chadshay et al. ..... 122/479 B

*Primary Examiner*—Albert J. Makay

*Assistant Examiner*—Steven E. Warner

*Attorney, Agent, or Firm*—William W. Habelt

[57] ABSTRACT

In a pulverized coal-fired steam generator having a generally vertical furnace (1) and a plurality of fuel-air admission assemblies (10) arrayed in a vertical windbox (40) in one or more walls of the furnace (1), at least one of the fuel-air admission assemblies (10) being a low load fuel-air admission assembly having a split coal bucket (30) with vertically adjustable upper and lower coal nozzles (32,34), the remaining assemblies having vertically adjustable single nozzle buckets (28), a tilt apparatus (50,60) for vertically adjusting all nozzles in unison in response to steam temperature at high loads and for vertically adjusting the lower coal nozzles of the split coal bucket of the low load fuel-air admission assembly independent of all remaining nozzles at low loads.

1 Claim, 3 Drawing Figures

BURNER-TILT DRIVE APPARATUS FOR A PULVERIZED COAL FIRED STEAM GENERATOR

BACKGROUND OF THE INVENTION

The present invention relates to pulverized coal-fired furnaces and, more particularly, to an apparatus for tilting a vertical array of fuel-air admission assemblies, at least one of which employs a split coal bucket for improved low load firing.

One method of firing coal in conventional coal-fired steam generator boilers is known as tangential firing. In this method, pulverized coal is introduced to the furnace in a primary air stream through burners, termed fuel-air admission assemblies, disposed in windboxes located in the corners of the furnace. Each windbox comprises a vertical array of alternate secondary air compartments and fuel-air admission assemblies. The fuel-air streams discharged from these burners are aimed tangentially to an imaginary circle in the middle of the furnace. This creates a fireball which serves as a continuous source of ignition for the incoming coal. More specifically, a flame is established at one corner which in turn supplies the required ignition energy to stabilize the flame emanating from a corner downstream of and laterally adjacent to it. However, at low loads the fireball deteriorates to four individual flames which frequently do not interact sufficiently to stabilize each other. Thus, at low loads it was frequently necessary to use auxiliary fuel such as light oil or natural gas to provide stabilization.

A distinct advantage of the tangential firing concept is that a wide range control of steam temperature can be obtained by tilting in unison the auxiliary air compartments and the fuel-air admission assemblies of the individual windbox upward or downward. By so doing, the fireball is physically raised or lowered within the furnace so as to increase or decrease the heat absorption by the furnace bounding waterwalls thereby effecting wide range control over the temperature of the combustion gases leaving the combustion zone and passing over downstream superheat and reheat surfaces. By tilting the fuel-air admission assemblies upward as load decreases, low load operation can be achieved while holding the overall cycle efficiency and maintaining better operation of the turbine. Additionally, the vertical adjustability of fuel-air admission assemblies permits the operator of the furnace to compensate for changes in heat absorption within a furnace waterwall resulting from fuel variations, in particular, for variations in the amount of slagging of the furnace waterwalls between different coals.

A recent improvement in the low load operation of coal-fired furnaces is disclosed in U.S. Pat. No. 4,252,069 issued Feb. 24, 1981. This patent discloses an improved fuel-air admission assembly incorporating a split coal bucket which permits a pulverized coal-fired furnace employing a tangential method to be operated at low loads without the use of auxiliary fuel to provide stabilization.

The low load fuel-air admission assembly disclosed in U.S. Pat. No. 4,252,069 comprises a split coal bucket having independently tiltable upper and lower coal nozzles pivotally mounted to the coal delivery pipe. When the furnace is operating at low load such as during minimum demand periods, the primary air and pulverized coal streams discharging from the coal delivery pipe are split into an upper and lower coal-air stream and independently directed into the furnace by tilting the nozzles away from each other. In so doing, an ignition stabilizing pocket is established in a locally low pressure zone created between the spread apart cool-air streams. Hot combustion products are drawn, i.e., recirculated, into this low pressure zone thus providing enough additional ignition energy to the incoming fuel to stabilize the flame and eliminating the need for auxiliary stabilizing fuel such as oil or natural gas.

U.S. Pat. No. 4,304,196, issued Dec. 8, 1981, discloses a tilt apparatus for use in conjunction with a windbox incorporating such a low load, split bucket fuel-air admission assembly. In accordance with this patent two completely independent tilt linkage means are provided, the first to link the single nozzle coal buckets and the upper nozzle of the split buckets together so as to tilt in unison and the second to link only the lower nozzles of the split coal buckets together so as to tilt in unison. Further, two independent tilt actuation means are provided, the first to actuate the first tilt linkage means, the second to actuate the second tilt linkage means. The first tilt actuation means which is associated with the first tilt linkage means is responsive solely to steam temperature, while the second tilt linkage means is responsive to steam temperature only at high loads and to load level at low loads.

It is an object of the present invention to provide an improved apparatus for vertically adjusting the fuel-air admission assemblies of windbox incorporating at least one such low load, split bucket fuel-air admission assembly wherein both the single bucket coal nozzles and the split bucket nozzles may be tilted in unison by the actuation of a single tilt actuation means at high loads in response to steam temperature, while still permitting the lower coal nozzles of the split buckets to be independently adjusted at low loads.

SUMMARY OF THE INVENTION

In a pulverized coal-fired steam generator having a generally vertical furnace and a plurality of fuel-air admission assemblies arrayed in a vertical windbox in one or more walls of the furnace for introducing coal and air into the furnace, at least one of the fuel-air admission assemblies being a low load fuel-air admission assembly having a split coal bucket with vertically adjustable upper and lower coal nozzles, the remaining fuel-air admission assemblies having vertically adjustable single nozzle coal buckets, an improved apparatus for adjusting the vertical orientation of the upper and lower coal nozzles of the low load fuel-air admission and the single nozzle coal buckets of the remaining fuel-air admission assemblies.

In accordance with the present invention, the improvement comprises providing linkage means for interconnecting the two independent tilt linkage means so thatsame may be adjusted in unison when the first tilt situation means is operated in response to steam temperature thereby tilting the lower coal nozzle of each split bucket fuel-air admission assembly in unison with the upper coal nozzles thereof as well as the single bucket coal nozzles, but also so that the second tilt linkage means may be operated independently of the first tilt linkage when the second tilt actuation means is operated in response to load level thereby tilting the lower coal nozzles of each split bucket fuel-air admission assembly independently of the upper coal nozzles of each split bucket fuel-air admission assembly.

In a preferred embodiment of the present invention, the linkage means comprises link bar interconnected between the first and second tilt linkage means which may be selectively lengthened and shortened by means of a length adjustment means operatively associated therewith whenever the second tilt actuation means is operated. The adjustment means comprises a pneumatic cylinder having an axially movable piston enclosed in an elongated cylindrical housing disposed in the link bar means between the first and second tilt linkage levers. The piston divides the interior of the cylindrical housing into a first chamber on one side of the piston and a second chamber on the opposite side of the piston. Fluid communication means are provided for supplying pneumatic fluid to and venting from pneumatic fluid and first and second chamber so as to move the piston axially within the cylindrical housing thereby selectively lengthening or shortening the link bar upon actuation of the second tilt actuation means. By selectively adjusting the length of the link bar interconnecting the first and second tilt linkage means, the angular relationship between the upper coal nozzle and the lower coal nozzle of each split bucket fuel-air admission assembly may be adjusted. The lower coal nozzles are tilted independently of the upper coal nozzles by the second tilt actuation means in response to load level, while both upper and lower coal nozzles, as well as the single bucket coal nozzles, may be tilted in unison by the first tilt actuation means in response to steam temperature.

DESCRIPTION OF THE PREFERRED EMBODIMENT

In the tangential firing method, fuel and air are introduced into the furnace through fuel-air admission assemblies 10 mounted in corner windboxes 40 located in the four corners of the furnace 1. The fuel-air admission assemblies 10 are oriented so as to deliver the pulverized coal and air streams tangentially to an imaginary circle 3 in the center of the furnace 1 so as to form a rotating vortex-like flame termed the fireball therein.

Figure 2:
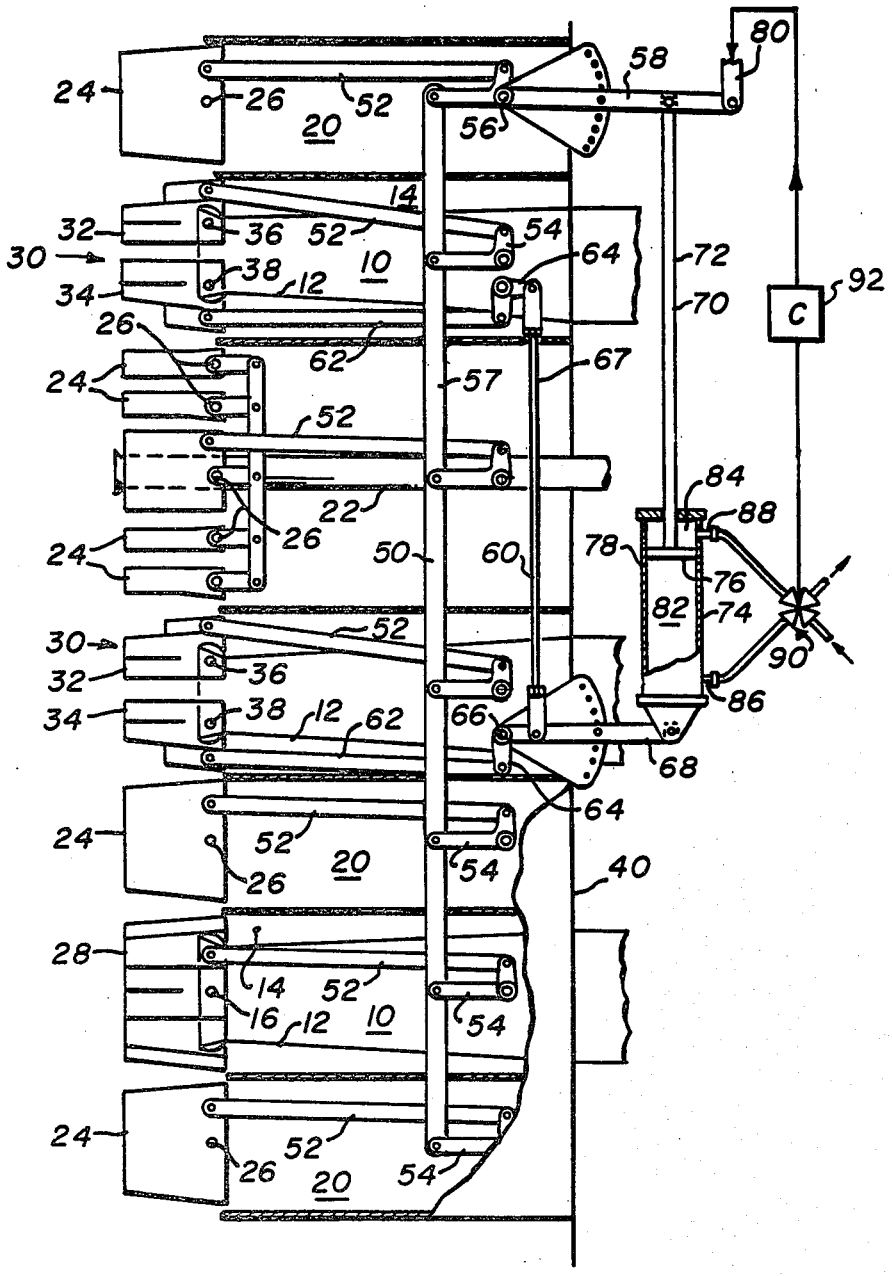
FIG. 2 is an elevational cross-sectional view, taken along line 2—2 of FIG. 1, of a windbox having a set of three fuel-air admission assemblies and of four auxiliary air compartments showing the tilt apparatus of the present invention.

As shown in FIG. 2, a plurality of fuel-air admission assemblies 10 are arranged in the corners in a vertical column within the windbox 40 separated by auxiliary air compartments 20. One or more of these auxiliary air compartments is adapted to accommodate an auxiliary fuel burner 22 which may be used when starting and warming up the boiler and which may be used when necessary to provide additional ignition energy to stabilize the coal flame when operating at low loads.

Each fuel-air admission assembly 10 comprises coal delivery pipe 12 extending therethrough and opening into the furnace, and a secondary air conduit 14 which surrounds the coal delivery pipe 12 and provides a flow passage so that secondary air may be introduced in the furnace as a steam surrounding the primary air-pulverized coal stream discharged from coal delivery pipe 12. Each coal delivery pipe 12 is provided with a tip, termed a coal bucket, which is pivotally mounted to the coal delivery pipe 12 so that the coal bucket may be tilted about an axis transverse to the longitudinal axis of the coal delivery pipe 12. Similarly, each auxiliary air compartment 20 and secondary air conduit 14 is equipped with one or more tiltable air nozzles 24.

A typical single nozzle coal bucket 28 is shown in FIG. 2 mounted to the coal delivery pipe 12 of the lower fuel-air admission assembly. Coal bucket 12 can be tilted upward or downward about axis 16 in order to direct the pulverized coal-primary air mixture into the furnace in an upward or downward angle as a means of controlling the position of the fireball within the furnace thereby controlling steam temperature in the manner taught by the U.S. Pat. No. 2,363,875, issued Nov. 28, 1944, to Kreisinger et al for "Combustion Zone Control".

The upper two fuel-air admission assemblies shown in FIG. 2 have a split coal bucket 30 pivotally mounted to their respective coal delivery pipes. As disclosed in U.S. Pat. No. 4,252,069, each split coal bucket 30 comprises an upper coal nozzle 32 and a lower coal nozzle 34 both of which are independently tiltable about their respective axes 36 and 38 transverse to the longitudinal axis of the coal delivery pipe 12. By tilting the upper nozzle 32 upward, a first portion of the primary air and pulverized coal mixture discharging from coal delivery pipe 12 may be selectively directed upwardly into the furnace as an upper coal-air stream. Similarly, by tilting the lower coal nozzle downward, a second portion of the primary air and pulverized coal mixture discharging from the coal delivery pipe 12 can be selectively directed downwardly into the furnace as a lower coal air stream.

First and second tilt linkage means 50, 60 provide for vertically adjusting the fuel-air admission assemblies in order to maintain steam temperature while at the same time permitting the lower coal nozzles 38 of the split buckets 30 of the low load fuel admission assemblies to be independently adjusting during the low load operation. As indicated earlier, when the furnace equipped only with single nozzle coal buckets 28 was operated at low load, ignition became unstable and supplemental fuel such as natural gas or oil had to be fired in order to provide sufficient additional energy to stabilize the ignition of the single coal-air stream. By providing a split coal bucket having independently tiltable upper and lower coal nozzles, stable ignition at low loads can be achieved without firing supplemental fuel.

As mentioned previously, a distinct advantage of the tangential firing concept is that wide range control of steam temperatures may be obtained by tilting in unison the auxiliary air compartment nozzles 24 and fuel-air admission assembly coal bucket nozzles 28, 32 and 34 upward or downward. When the steam temperature departs from the preselected value, means 50 for adjusting the main tilt is activated. As load is reduced, steam temperature tends to drop. Accordingly, in response to this drop in steam temperature first tilt control lever 58 is driven in a clockwise direction by first tilt actuation means 80 about pivot point 56 thereby causing the upper bell crank 54 to similarly rotate in a clockwise direction about pivot point 56 and the vertical extension arm 57 to translate upward. As extension arm 57 moves upward, each of the individual bell cranks 54 rotates clockwise thereby causing their associated link rods 52 to translate rearward in the windbox. As links 52 translate rearward, air nozzles 24 and oil gun 22 tilt upward by rotating about their respective pivot points 26, the single nozzle coal bucket 28 tilts upward by rotating about pivot points 16, and the upper nozzle 32 of the split coal buckets 30 tilt upward by rotating about their respective pivot points 36.

The second tilt linkage means 60 provides for adjusting the vertical orientation of the lower nozzle 34 of the split coal buckets 30. For example, if the second tilt control lever 68 is driven in a clockwise direction about pivot point 66, the lower bell crank 64 is rotated in a clockwise direction about pivot point 66 and the vertical extension arm 67 translates downward. As extension arm 67 translates downward, each of the remaining bell cranks 64 to also rotate clockwise thereby causing their respective link rods 62 to translate forwardly in the windbox. As link rods 62 translate forwardly, the lower coal nozzles 34 of the split coal buckets 30 tilt upward by rotating clockwise about their respective pivot points 36.

Conversely, if the second tilt control level 68 is driven in a counterclockwise direction about pivot point 66, the vertical extension arm 67 translates upwards, bell cranks 64 rotate counterwise, and link rods 62 translate rearwardly in the windbox thereby causing the lower coal nozzles 34 of the split coal buckets 30 to tilt downward by rotating counterclockwise about their respective pivot points 36.

In accordance with the present invention, third linkage means 70 is provided for interconnecting the first linkage means 50 and the second first means 60. As shown in the best mode embodiment of the present invention illustrated in FIG. 2, the third linkage means 70 preferably comprises a link bar 72 extending vertically between tilt control lever 58 of the first tilt linkage means 50 and the tilt control lever 68 of the second tilt linkage means 60; and adjustment means 74 operatively associated with the link bar 70 for selectively lengthening or shortening the link bar 70 in response to the second tilt actuation means 90. Preferably, the adjustment means 74 comprises a pneumatic cylinder having an axially moveable piston 76 enclosed in an axially elongated cylindrical housing 78. The pneumatic cylinder is disposed in the link bar 70 with one end of the link bar 70 secured to the piston 76 and the tilt control lever 68 of the second tilt linkage means 60 secured to the opposite end of the cylindrical housing 78. The piston 76 divides the cylindrical housing 78 into a first chamber 82 on one side of the piston and a second chamber 84 on the opposite side of the piston. Means 86 and 88 provide fluid communication with the first chamber 82 and the second chamber 84 respectively through which pneumatic fluid may be supplied to and vented from the chambers.

Figure 1:
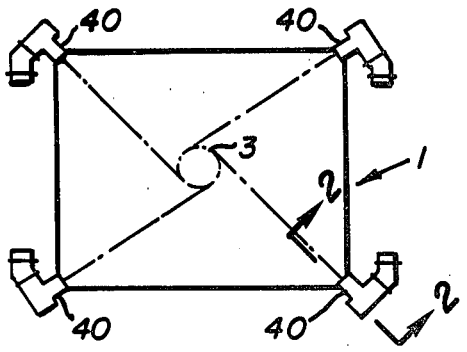
FIG. 1 is a diagrammatic plan view of a furnace employing the tangential firing method.
Figure 3:
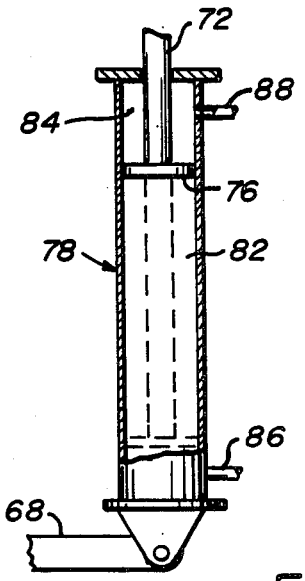
FIG. 3 is an enlarged elevational view, partly in section, of a preferred embodiment of an adjustment means for selectively lengthening or shortening the linkage means interconnecting the first and second tilt linkage mechanisms of FIG. 2.

The adjustment of the length of link bar 72 is best illustrated in FIG. 3. The solid-line piston respresents the piston 76 disposed in its fully extended position which corresponds to a fully lengthened link bar 70 as shown in FIG. 2. With the link bar 70 in its lengthened position, the lower coal nozzle 34 of the split coal bucket 30 will always be parallel to the upper coal nozzle 32 of the split coal bucket 30. The piston 76 is held in its extended position by selectively supplying pneumatic fluid to the first chamber 82 and venting same from the second chamber 84.

To shorten the length of the link bar 70, pneumatic fluid is selectively vented from the first chamber 82 and supplied to the supplied chamber 82 to cause the piston 76 to retract within the housing 78. The dashed-line piston represents the piston 76 disposed in its fully retracted position which corresponds to a fully shortened link bar 70. With the link bar 70 in its shortened position, the lower coal nozzle 34 of the split bucket 30 would be tilted away from the upper coal nozzle 32 of the split coal bucket 30 so that an angular separation in the range of 20° to 25° exists between the upper nozzles 32 and the lower nozzles 34.

To adjust the length of the link bar 70, pneumatic fluid is supplied to or vented from the first and second chambers by means of the second tilt actuation means 90, which is shown in FIG. 2 as valve means. Preferably the valve means 90 is a four-way solenoid valve through which pneumatic fluid can be supplied from an external source of pneumatic fluid selectively to either the first or second chambers 82 and 84 of the cylinder housing 78 and returned to the external source from either the first or second chambers.

When separating the furnace at higher loads, i.e., loads above approximately 30 percent of full load, the link bar 70 would be fully lengthened by supplying pneumatic fluid to the first chamber 82 of the pneumatic cylinder 74. As mentioned previously, the lower nozzles 34 and the upper nozzles 32 of the split coal buckets 30 would then be parallel. The first tilt actuation means 80 would control the tilt of both the upper and lower nozzles of the split bucket and also the single nozzle coal buckets so as to maintain steam temperature at a desired level.

If the steam temperature dropped below the desired level, first tilt actuation means 80 would respond to a signal from controller 92 by rotating the first control level 58 clockwise so as to cause the first tilt linkage means 50 to tilt the single nozzle coal buckets 24 and the upper nozzles of the split buckets 32 upward in the manner previously described. Additionally, as the first control lever 58 rotates clockwise, the link bar 70 translates downward causing the second control lever 68 to also rotate clockwise so as to cause the second tilt linkage means 60 to tilt the lower nozzles of the split buckets 32 upward in the manner described previously in unison in response to the first tilt actuation means 80.

When operating the furnace at low loads, i.e. loads under approximately 30 percent of full load, the link bar 70 would be shortened by supplying pneumatic fluid to the second chamber 84 of the pneumatic cylinder 74. The second tilt actuation means 90 would respond to a signal from controller 92 by supplying pneumatic fluid to the second chamber 84 of the pneumatic cylinder and venting pneumatic fluid from the first chamber 82 thereof to shorten link bar 70 and thereby actuate the second tilt linkage means 60 to tilt the lower nozzles of the split coal buckets away from the upper nozzles of the split coal bucket to establish and spread apart angular relationship therebetween. By spreading the upper and lower nozzles apart, a stable ignition pocket is produced between the coal-air streams emitted from the spread apart nozzles of the split bucket. Preferably, all nozzles are first adjusted in response to the first tilt actuation means 80 in response to steam temperature before the link bar 70 is shortened in response to the second tilt actuation means 90 to stabilize low load operation.

I claim:

1. In a pulverized coal-fired steam generator having a generally vertical furnace and a plurality of fuel-air admission assemblies arrayed in a vertical windbox in at least one wall of the furnace for introducing coal and air into the furnace, at least one of said fuel-air admission assemblies being a low load fuel-air admission assembly having a split coal bucket having vertically adjustable upper and lower coal nozzles, the remaining fuel-air admission assemblies having vertically adjustable single nozzle coal buckets; an apparatus for adjusting the vertical orientation of the upper and lower coal nozzles of said low load fuel-air admission assembly and the single nozzle coal buckets of the remaining fuel-air admission assemblies comprising:

a. first tilt linkage means interconnecting the upper coal nozzles of each low load fuel-air admission assembly disposed in said windbox and each single nozzle coal bucket disposed in said windbox;

b. second tilt linkage means interconnecting the lower coal nozzles of each low load fuel-air admission assembly disposed in said windbox;

c. link bar means interconnected between said first tilt linkage means and said second tilt linkage means, said link bar means being of selectively adjustable length;

d. a pneumatic cylinder having an axially movable piston enclosed in an axially elongated cylindrical housing interdisposed in said link bar means between said first and second tilt linkage means, the piston dividing the interior of said cylindrical housing into a first chamber on one side of the piston and a second chamber on the opposite side of the piston;

e. first conduit means in fluid communication with the first chamber through which pneumatic fluid may be supplied to and vented from the first chamber; and f. second conduit means in fluid communication with the second chamber through which pneumatic fluid may be supplied to and vented from the second chamber;

g. a first tilt actuation means for actuating said first tilt linkage means so as to tilt the upper coal nozzle of said low load fuel-air admission assemblies in unison with the single nozzle coal buckets of the remaining fuel-air admission assemblies; and h. a second tilt actuation means comprising control valve means operatively associated with said first and second conduit means for selectively controlling the piston pneumatic fluid flow between the first and second chambers so as to cause the piston to be displaced axially within said cylindrical housing thereby lengthening or shortening said link bar means interconnecting said first tilt linkage means with said second tilt linkage means.

* * * * *